United States Patent [19]

Verboom

[11] 4,400,895

[45] Aug. 30, 1983

[54] DRAG HEAD FOR A HOPPER SUCTION DREDGE

[75] Inventor: Pieter Verboom, Alblasserdam, Netherlands

[73] Assignee: IHC Holland N.V., Papendrecht, Netherlands

[21] Appl. No.: 368,817

[22] Filed: Apr. 15, 1982

[30] Foreign Application Priority Data

Apr. 15, 1981 [NL] Netherlands ..... 8101858

[51] Int. Cl.[3] ..... E02F 3/88

[52] U.S. Cl. ..... 37/58

[58] Field of Search ..... 37/58, 61, 62, 63

[56] References Cited

U.S. PATENT DOCUMENTS 4,083,134 4/1978 Oterdoom ..... 37/58

FOREIGN PATENT DOCUMENTS 364866 12/1922 Fed. Rep. of Germany .
702555 2/1941 Fed. Rep. of Germany .
417535 11/1910 France .
1399762 4/1965 France .
13035 3/1925 Netherlands .
54217 3/1943 Netherlands .
6501314 8/1965 Netherlands .
7000732 7/1971 Netherlands .
7514881 12/1975 Netherlands .
7714438 12/1977 Netherlands .
7902737 4/1979 Netherlands .
1056632 1/1967 United Kingdom ..... 37/63
375353 5/1973 U.S.S.R. ..... 37/63

OTHER PUBLICATIONS

Konstruktion, vol. 16, 1964, No. 11 (Berlin) by W. Witt: "Entwicklung neuer Schleppesaugkopfe fur selbstfahrende Laderaumsaugbagger" blz. 461–470, blz. 466, col. 2, paragraphs 2 & 3, FIG. 20.

*Primary Examiner*—Clifford D. Crowder
*Attorney, Agent, or Firm*—Young & Thompson

[57] ABSTRACT

Drag head for a hopper suction dredge, which drag head has a suction opening in the dragging direction, defined by side walls and a rear wall. The lower edges of these walls are positioned in one plane whereby the rear edge is positioned lower then the upper edge of the inlet opening with respect to a vertical cross sectional plane parallel to the dredging direction. The side edges and the rear edge are positioned in an essentially horizontal plane. The rear wall of the drag head extends upwards along a compound bent line such that the tangent of this line at the height of a horizontal plane through the upper edge of the inlet opening is inclined forwards at an acute angle.

3 Claims, 2 Drawing Figures

DRAG HEAD FOR A HOPPER SUCTION DREDGE

The invention relates to a drag head for a hopper suction dredge, which drag head has a suction opening in the dragging direction, and the side walls and a rear wall of which have lower edges which are positioned in one plane such that the rear edge is positioned lower than the upper edge of the inlet opening.

Such a drag head is known e.g. from the Dutch Pat. application No. 7902737, which is laid open for public inspection, and said drag head is especially destined for dragging sludge and mud. This known drag head has an inlet incorporating the rear wall and the side walls, which is swung around a horizontal transverse axis and defines, dependent on the setting and the inclination angle of the suction pipe, a forwardly directed inlet opening by means of said rear wall and side walls of the inlet. The upper edge of the inlet functions as a cutting means destined to attack a certain slice of a sludge layer, the thickness of said slice essentially corresponding to the height of the inlet or suction opening. To prevent biting of said cutting edge into layers of increased density a sliding shoe is provided engaging the dredged bottom behind the drag head. A disadvantage of such a drag head is, that the head is liable to become hooked behind obstacles such as big stones etc.

Sludge or mud is a material which is difficult to dredge. Not only because the settling in the hopper progresses very slowly, but especially because the sludge layer deposited on a solid bottom can have changing heights and, which is even more important, varying concentrations or density. A cutting drag head, penetrating the solid subsoil or a layer of increased concentration and some carrying capacity, will intend to become stuck. If one takes care that the carrying or hoisting cables of the suction pipe keep the drag head at a sufficient distance from the solid subsoil, then the danger that the drag head will bite is more or less eliminated, however, taking into consideration that the drag head will be positioned in a layer of less density whereas with increased swell it cannot be prevented, notwithstanding the use of swell compensators, that the suction head will penetrate into undesirable concentrations which are too thin or too solid, upwards as well as downwards.

An object of the invention is to provide a very simple drag head by means of which sludge and mud can be sucked with a good efficiency, which drag head can move very easily over roughnesses such as stones etc.

Said object is according to the invention achieved in that with respect to a vertical cross sectional plane parallel to the dredging direction the side edges and the rear edge are positioned in an essentially horizontal plane and the rear wall of the drag head extends upwards along a compound bend line such that the tangent of this line at the height of a horizontal plane through the upper edge of the inlet opening is inclined forwards at an acute angle. The principal part of this drag head is the rear wall. Because of the weight of the suction pipe and the drag head said rear wall will penetrate the mud layer, and slides over the mud layer during the dragging operation and presses said mud layer forwardly because of the wedge action with the mud layer and moves said mud layer so to speak in the direction of the suction opening. Dependent on the pressure of the suction head on the bottom, controlled by means of the supporting and hoisting cables, said suction head is able to penetrate the sludge layer, whereby also the drag speed plays an important role for moving upwards a part of the sludge layer having a higher concentration, if said part is not already sucked through the suction opening. The horizontal side edges thereby cut into the sludge layer and close the sides of the drag.

The term "horizontal" covers also a small inclination angle of the suction head dependent on the operation depth.

The rear wall extends upwards according to a continuous compound bend line to achieve a squeezing and pressing action. A further improvement is realized when a rear wall according to the invention is embodied as a cylindrical roll positioned closely between the side plates of the head and rotatably supported in said head, which roll engages closely the upper wall of the drag head. Said roll has, better than a plate, the capability to break the elastic coherence in the sludge and to press and mould this sludge in a forward direction. Such a roll can be driven in the rolling direction or in the opposite direction such that also a friction force is exerted on the sludge. The pressure on the sludge layer can be varied by variation of the weight load.

To allow adaptation to the instantaneous circumstances and to obtain thereby a favourable and very concentrated flow in the drag head, it is furthermore preferred that the upper edge of the inlet opening comprises a swingable or movable inlet body with a longitudinal sectional drop shaped flow profile. By means of this inlet body below which the entering flow passes, the height of the inlet opening can be adapted to the density of the sludge layer.

The drag head according to the invention has the advantage that in agreement with the drag speed and with the operating depth the sludge layer of the highest concentration and specific weight can be sucked without any danger of biting and with very easy control possibility. In essence the head roles over the sludge layer and penetrates into said layer as far as is functionally necessary.

It is remarked that from the Dutch patent application 7513146, which is laid open to public inspection, a drag head is known in which also a freely rotatable roll is provided. However, said roll has no closed cylindrical outer surface, but is provided with openings the function of which is to form inlet openings of the suction head and to grub into the layer to be dredged. Said drag head comprises at the rear side an adjustable inlet and closes in essence in all directions to the bottom.

The invention will be explained in more detail with reference to the drawing.

Figure 1:
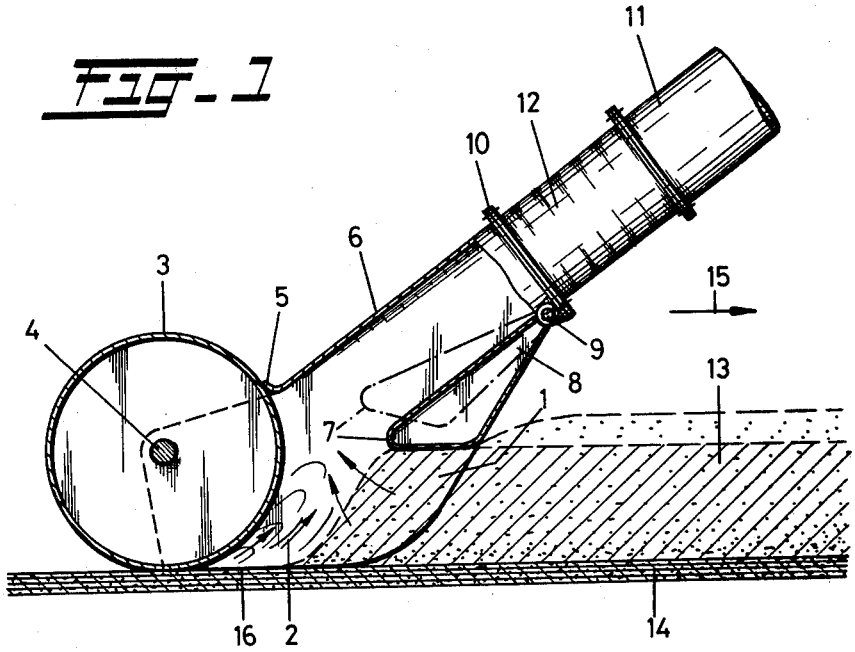
FIG. 1 illustrates a longitudinal section view of one embodiment of the drag head according to the invention.

FIG. 1 illustrates a drag head with an inlet opening 1, side walls 2 and a rear wall which is formed by a cylindrical roll 3, supported between the side walls 2 by means of the shaft 4, which roll engages the upper wall 6 of the head closely at 5. The upper edge of the inlet opening 1 is formed by the bent under edge 7 of the streamlined inlet body 8, which is in the illustrated embodiment swingable at 9 around a horizontal shaft and connected by means of said shaft.

The drag head has a flange 10, by means of which the drag head is connected to a suction tube 11 whereby eventually a hose section 12 and a not illustrated pivot means, e.g. a universal joint, is installed inbetween.

The mud layer to be dredged is in FIG. 1 denoted by 13 and said figure illustrates how the roll 3 rests on the solid bottom 14 and closes the head at the rear thereby moulding the sludge layer during the dragging operation in the direction of the arrow 15.

The side walls 2 have under edges 16 running in essence horizontally and extending upwards along the inlet opening 1. The adjustable body 8 is positioned between those side plates 2 in a closely spaced but adjustable manner. Said body can move to the position illustrated by dot and dash lines to increase the height of the inlet opening.

Figure 2:
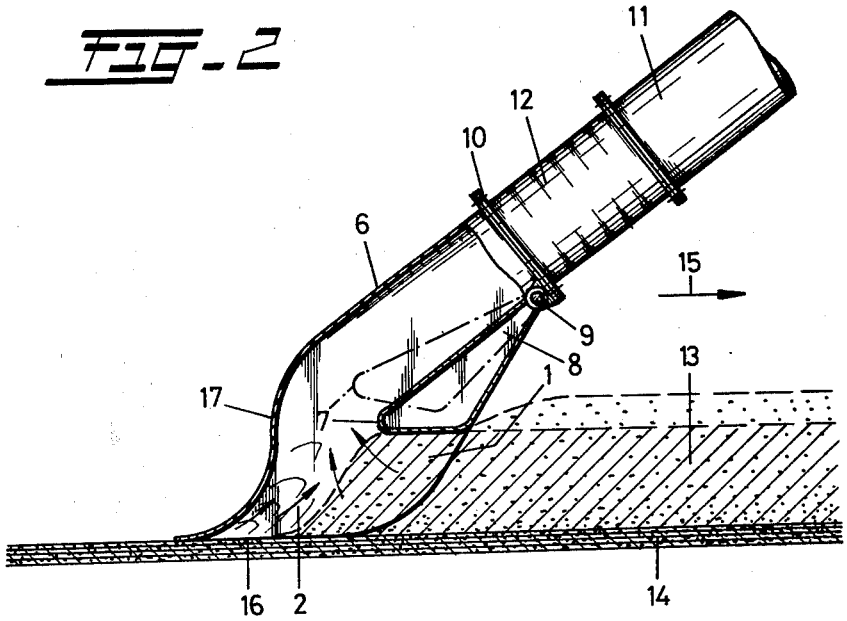
FIG. 2 illustrates another embodiment in a view corresponding to FIG. 1.

FIG. 2 corresponds to FIG. 1, however, with the difference that instead of a roll a bended plate 17 is used which slides over the mud layer.

I claim:

1. In a drag head for a hopper suction dredge, which drag head has a suction opening that opens in the dragging direction and which is defined only by an upper edge, two side walls and the soil to be dredged, and which has a rear wall which is closed and has its lower edge lower than the upper edge of the inlet and in the same plane as the lower edges of the side walls; the improvement in which the lower edge of the rear wall and the lower edges of the side walls are disposed in a common horizontal plane, said rear wall extending upwardly and forwardly in the dredging direction with an upwardly concave curvature followed by a reverse bend and a downwardly concave curvature, and which said drag head has an inlet body whose lower surface comprises said upper edge of the inlet, and means mounting said inlet body for vertical swinging movement on the drag head about a horizontal axis.

2. In a drag head for a hopper suction dredge, which drag head has a suction opening that opens in the dragging direction and which is defined only by an upper edge, two side walls and the soil to be dredged, and which has a rear wall which is closed and has its lower edge lower than the upper edge of the inlet and in the same plane as the lower edges of the side walls; the improvement in which the lower edge of the rear wall and the lower edges of the side walls are disposed in a common horizontal plane, said rear wall being comprised by a roller carried by the drag head between said side walls, the bottom of said roller constituting said lower edge of said rear wall.

3. A drag head as claimed in claim 2, and an inlet body whose lower surface comprises said upper edge of the inlet, and means mounting said inlet body for vertical swinging movement on the drag head about a horizontal axis.

* * * * *